United States Patent [19]

Helmholdt et al.

[11] Patent Number: 4,746,021

[45] Date of Patent: May 24, 1988

[54] WINDOW SHELF ASSEMBLY

[76] Inventors: Diane E. Helmholdt; Charles D. Helmholdt, both of 7070 Thornapple River, Caledonia, Mich. 49316

[21] Appl. No.: 894,644

[22] Filed: Aug. 8, 1986

[51] Int. Cl.[4] ..... A47F 5/08

[52] U.S. Cl. ..... 211/90; 211/94.5; 211/187; 108/111; 108/149

[58] Field of Search ..... 211/90, 94.5, 103, 189, 211/190, 186, 187, 175, 64; 108/149, 111

[56] References Cited

U.S. PATENT DOCUMENTS

| | | | |
|---|---|---|---|
| 179,071 | 6/1876 | Shirley . | |
| 200,767 | 2/1878 | Sanderson | 211/103 X |
| D. 248,071 | 6/1978 | Simmons | D6/06 |
| D. 251,524 | 4/1979 | Boyajian | D6/135 |
| 342,476 | 5/1886 | Swartwout . | |
| 678,031 | 7/1901 | Peach . | |
| 698,762 | 4/1902 | Tove . | |
| 841,574 | 1/1907 | Sandhofer . | |
| 883,001 | 3/1908 | Curtis . | |
| 1,394,947 | 10/1921 | Singer | 211/90 X |
| 2,051,241 | 8/1936 | Biggers . | |
| 2,917,187 | 12/1959 | Bergkvist | 211/90 X |
| 3,139,045 | 6/1964 | Rojakovick | 108/149 X |
| 3,294,247 | 12/1966 | Norrington | 211/64 |
| 3,948,581 | 4/1976 | Helman et al. | 108/111 X |
| 4,122,781 | 10/1978 | Potter | 108/111 X |
| 4,188,891 | 2/1980 | Boyajian | 211/88 X |

*Primary Examiner*—Ramon S. Britts
*Assistant Examiner*—Blair M. Johnson

[57] ABSTRACT

A shelf assembly (10) is adapted to securely mount to a wall (12) adjacent a window frame (14) and in front of a window (18). The window frame (14) comprises an upper portion (20), a lower portion (22) and a pair of identical side elements (24). The assembly (10) includes a pair of bridges (42) mounted to the wall (12) above and below the upper and lower portions (20, 22), respectively, of the window frame (14) and in a position in front of the side elements (24). Each bridge (42) comprises a pair of uprights (26), with each upright (26) having a long vertical part (30), a short vertical part (32) and a central part (34) connecting the long and short vertical parts (30, 32) and angled with respect thereto so as to position the long and short vertical parts (30, 32) in different substantially vertical planes. The uprights (26) of each bridge (42) are mounted to the wall (12) in inverted relationship so that the long vertical parts (30) are disposed in overlapping relationship and positioned outwardly with respect to the short vertical parts (32) which are connected to the wall (12). At least one shelf (76) is mounted to and between the bridges (42) so as to be disposed in front of the window (18).

16 Claims, 5 Drawing Sheets

WINDOW SHELF ASSEMBLY

FIELD OF THE INVENTION

This invention pertains to a device for adjustably supporting potted plants and the like in a position adjacent to a window.

DESCRIPTION OF THE PRIOR ART

Recent trends in residential and commercial interior design have lead to the use of indoor potted plants to accent the aesthetic attractiveness of the interior living and working spaces of homes, offices and the like. In order for plants to survive, they require exposure to sunlight, which may be reached by placing the plants in close proximity to windows. Positioning of potted plants near windows has been traditionally accomplished by either setting potted plants on the floor adjacent large floor-to-ceiling windows, such as sliding-door windows, and on windowsills or hanging the plants from the ceiling and/or ceiling beams adjacent the windows by the use of hooks rigidly secured to the ceiling or beams and a flexible suspension means, such as ropes or wires, connected to and between the hooks and planters. Placement of potted plants on windowsills and floors, directly in front of or adjacent to windows may, however, interfere with the operation of window shades, blinds or curtains. In addition, positioning planters on the floor may tend to restrict living or working space in smaller houses and offices and in apartments and condominiums.

In order to circumvent the foregoing problems, it is functionally desirable to employ a device which positions potted plants in close proximity to windows, permits unhindered operation of shades and blinds and does not encroach on the interior space of homes and offices. It is also desirable to accomplish these functions without subtracting from the aesthetic beauty of the interior of the room. Devices of this type have been available. For example, the U.S. Pat. No. 179,071, issued June 20, 1976, to Shirley discloses a wall-mounted flower stand designed for interior use and comprising a pair of lugs rigidly secured to a window frame, underneath the window and on opposite sides thereof, a pair of side brackets removably secured to the lugs at the lower portions of the brackets and a pair of chains rigidly secured to the window frame, above the window and on opposite sides thereof, at the inner ends of the chains and to the upper portions of the brackets at the outer ends of the chains. In addition, a plurality of planter holders are supported to and between the brackets in stacked relationship to one another.

In addition, the U.S. Pat. No. 888,001, to Curtis issued Mar. 24, 1908, discloses a shelf assembly securable to a window frame and for carrying potted plants and the like. The assembly includes a pair of shelfsupporting brackets rigidly secured to the side members of the window frame at the inner ends of the brackets and a shelf secured to and between the brackets. The shelf is comprised of two half pans slidably connected in telescoping relationship. Thus, the shelf may be extended or contracted to fit windows of various size.

Finally, the U.S. Pat. No. 4,188,891, to Boyajian issued Feb. 19, 1980, discloses an indoor plant support for use in front of a window. The support includes a pair of elongated support members which rest on the windowsill, a pair of cables secured to and between the upper part of the window frame and the top of the support members so as to suspend the support members upwardly and inwardly into the interior of the room, and a pair of shelves secured to and between the support members. Each shelf comprises a pair of horizontally disposed brackets slidably mounted to the support members, to allow vertical adjustment thereof, and carrying a plurality of rails on which potted plants and the like are adapted to be positioned.

SUMMARY OF THE INVENTION

A shelf assembly is adapted to mount to a wall adjacent a window frame. The window frame comprises an upper horizontal portion, a lower horizontal portion and a pair of side portions. The shelf assembly includes a pair of bridges adapted to mount to the wall adjacent the window frame. Each bridge comprises a pair of uprights and each upright comprises a long vertical part, a short vertical part and a central part connected to and between the short and long vertical parts and angled with respect thereto. The uprights are adapted to mount to the wall in inverse relationship to one another so that the short vertical parts engage the wall above and below the upper and lower horizontal portions, respectively, and the long vertical parts are positioned in overlapping relationship in a substantially vertical plane in front of the side portions of the window frame. In addition, the shelf assembly includes at least one shelf adapted to be rigidly secured to and between the bridges.

In addition, the long vertical parts of the bridges are positioned in spaced-apart relationship so as to define vertical channels therebetween. The shelf assembly further comprises a top spacer connected to and between the bridges and positioned in the vertical channels at top ends of the bridges, and a pair of bottom spacers secured to the bridges and positioned between the long vertical parts of the uprights and in the channels at bottom ends of the bridges. The shelf also includes a connector beam having a bottom portion and a pair of flanges on terminal ends of the connector beam. The connector beam is adapted to be secured to and between the bridges such that the flanges are positioned in the vertical channels between the top spacer and the bottom spacers. In addition, the shelf comprises a plurality of shelf elements positioned on lateral edges of the connector beam and a pair of base supports having recessed portions adapted to receive the bottom portion of the connector beam adjacent the terminal ends thereof and adapted to be rigidly secured to the connector beam and the shelf elements to securely position the connector beam and the shelf elements in substantially the same horizontal plane.

Preferably, the long vertical parts of the uprights include a plurality of vertically spaced holes, the holes on the overlapping uprights of each bridge adapted to align. In addition, the top spacer preferably includes a pair of openings on free ends thereof and adapted to align with first selected sets of aligned holes in the overlapping uprights when the top spacer is positioned in the vertical channels. Also, the bottom spacers preferably include a pair of apertures adapted to align with second selected sets of aligned holes in the overlapping uprights when the bottom spacers are positioned in the vertical channels. Further, the shelf assembly comprises a pair of first pins and a pair of second pins adapted to extend through each set of aligned holes and openings and each set of aligned openings and apertures, respectively, to rigidly secure together the uprights of the bridges in spaced-apart relationship. In this manner, the assembly is adapted to adjustably mount to the wall adjacent the window frame by selectively aligning the holes of the overlapping uprights, the openings of the top spacer and the apertures of the bottom spacers so as to vary the vertical dimensions of the bridges.

In addition the flanges of the connector beam preferably include a pair of orifices adapted to align with third selected sets of aligned holes in the overlapping uprights. Also, the shelf assembly comprises a pair of third pins adapted to extend through the selected sets of aligned holes and orifices to rigidly secure the shelf to the bridges. In this manner, the shelf is adapted to vertically adjustably mount to and between the bridges by selectively aligning the orifices of the connector beam with corresponding sets of aligned holes of the overlapping uprights.

Finally, the shelf assembly preferably includes a drip pan securely attached to the shelf on bottom sides thereof.

BRIEF DESCRIPTION OF THE DRAWINGS

The invention will now be described with reference to the drawings in which.

DESCRIPTION OF THE PREFERRED EMBODIMENTS

Figure 1:
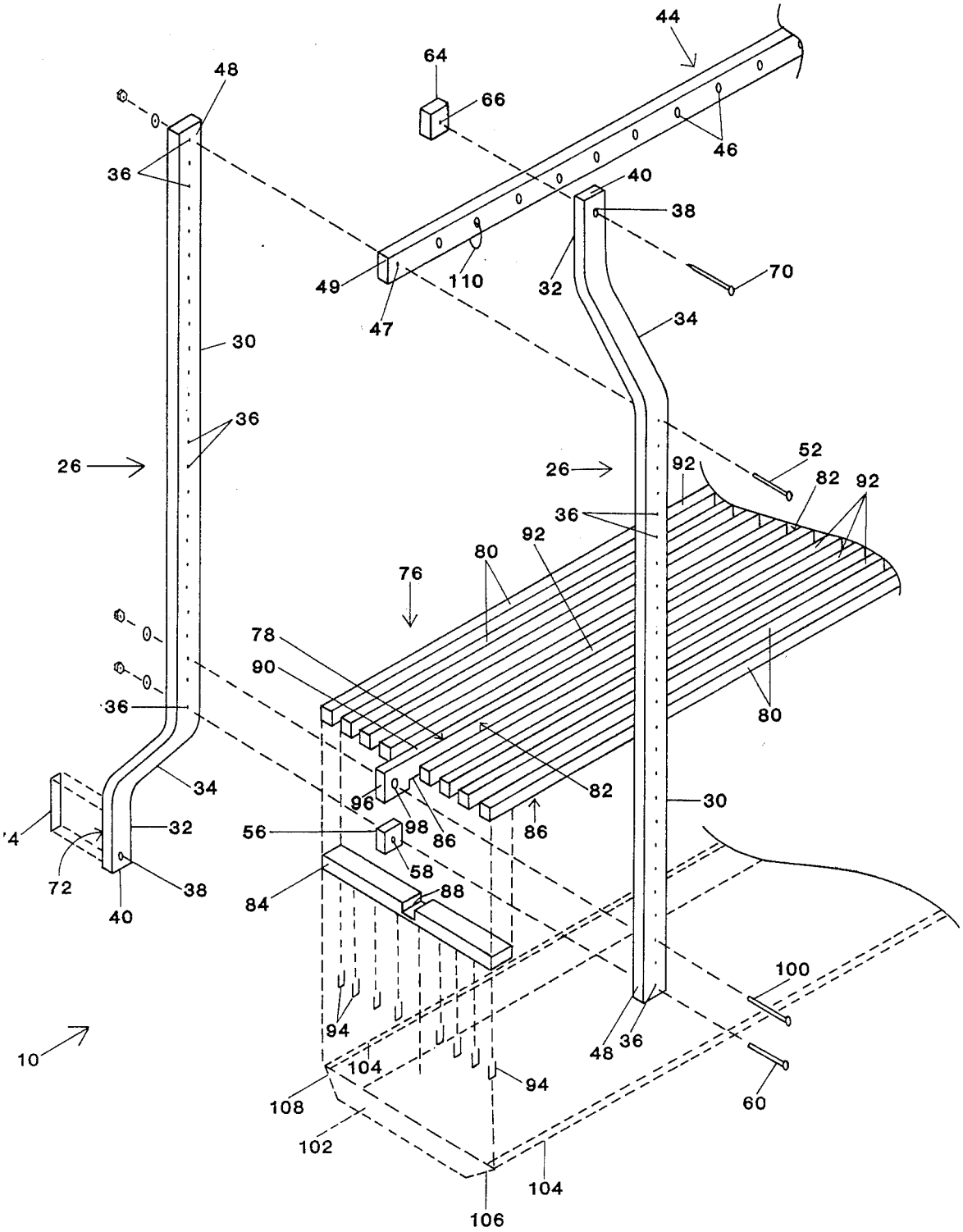
FIG. 1 is an exploded perspective view of a window mountable shelf assembly in accordance with the invention.

Referring to the drawings in detail, there is shown a shelf assembly 10 adapted to be securely mounted to an interior wall 12 of a building adjacent a window frame 14 and for supporting growing plants 16 or the like near a window 18 and in a position to receive optimal sunlight.

The window frame 14, next to which the assembly 10 is adapted to mount, is rigidly secured to the interior wall 12 and is of conventional design comprising an upper horizontal portion 20, a lower horizontal portion 22 and a pair of identical vertical side elements 24. Although the assembly 10 is shown in connection with one particular size window, as hereinafter described the assembly can be made to adapt to a variety of standard-size windows having various widths and heights. For example, the shelf assembly 10 can be constructed to mount adjacent windows which extend substantially from the ceiling (not shown) to the floor (not shown), commonly referred to as sliding-door windows.

The shelf assembly 10 includes a pair of uprights 26, on each identical side 28 of the assembly, and is adapted to be rigidly secured to the wall 12. Specifically, each upright 26 comprises a long, substantially vertical part 30, a short, substantially vertical part 32 and a central part 34 connecting the long and short vertical parts and angled with respect to the same so as to position the long and short vertical parts in distinct substantially vertical planes. In addition, each upright 26 has a series of equidistantly spaced first holes 36 running down the length of the long vertical part 30 of the upright 26. An upright 26, on each side of the assembly 10, includes a second hole 38 extending through the short vertical part 32 adjacent a terminal edge 40 of the same.

A pair of uprights 26 are mounted to the wall 12 adjacent a side element 24 of the frame 14 in inverted relationship with respect to one another so that the long vertical parts 30 of the uprights are positioned in overlapping relationship, with the upright having the second hole 38 positioned upwardly and outwardly with respect to the other upright and the first holes 36 of the long vertical parts aligned. In addition, so mounted, the short vertical parts 32 of the uprights are connected to the wall 12 above and below the upper and lower portions, respectively, of the window frame 14. Further, each pair of uprights 26 forms a bridge 42 over a side element 24 of the frame 14, whereby the long vertical parts 30 of the uprights are positioned outwardly from the side element with respect to the short vertical parts 32.

The assembly 10 also includes a top spacer 44 spanning the entire width of the window 18 and having a series of equidistantly spaced apertures 46 running along the length thereof and an opening 47 extending through each free end 49 of the top spacer 44. The top spacer 44 is positioned between the uprights 26 of each bridge 42 so that the aligned first holes 38 of the uprights are set in registry with the openings 47 of the top spacer. Specifically, on each side 28 of the assembly 10, the top spacer 44 is connected to and between a terminal end 48 of the long vertical part 30 of the inner lower upright 26 and the long vertical part 30 of the upper outer upright adjacent the central part 34 of the same. In this manner, the top spacer 44 functions to position the uprights 26 of each bridge 42, in spaced relationship with respect to one another so as to define a vertical channel 50 between the uprights. Further, a pair of first pins 52 are adapted to extend through the two sets of aligned first holes 36 and openings 47 to securely attach the uprights 26 of each bridge 42 together in spaced relationship at top portions 54 of the bridges.

Further, the assembly comprises a pair of bottom spacers 56, with each bottom spacer having a second opening 58 extending therethrough. On each side 28 of the assembly 10, a bottom spacer 56 is positioned between the terminal end 48 of the long vertical part 30 of the outer lower upright 26 and the long vertical part 30 of the lower inner upright adjacent the central part 34 of the same so that the second opening 58 is aligned with a pair of aligned holes 38. In this manner, the bottom spacers 56 aid the top spacer 44 in positioning the uprights 26, of each bridge 42, in spaced relationship. A pair of second pins 60 are adapted to extend through the pair of aligned first holes 38 and second openings 58 to securely attach the uprights 26 of the bridges 42 together at bottom portions 62 thereof.

The uprights 26 of each bridge 42 are connected to the wall 12, above the upper portion 20 of the window frame 14, by a connector block 64. Each connector block 64 has a first bore 66 extending therethrough and is positioned between the terminal edge 40 of the short vertical part 32 of the upper outer upright 26 and the wall 12 such that the second hole 38 is set in registry with the first bore 66. A pair of third pins 70 are adapted to extend through each set of aligned second holes 38 and first bore 66 and into the wall 12 to rigidly secure the uprights 26 to the wall. Rather than being rigidly secured to the wall 12, as are the terminal edges 40 of the upper outer uprights 26, the terminal edges 40 of the inner lower uprights 26 merely rest against the wall 12. Specifically, the rear surfaces 72 of the short vertical parts 32 of the inner lower uprights 26 mattingly engage wall 12 adjacent the lower portion 22 of the window frame 14. In this manner, the short vertical parts 32 of the inner lower uprights 26 aid the terminal edges 40 of the upper outer uprights in preventing inward rotational movement of the shelf assembly 10 and stabilizing the bridges 42 in substantially vertical planes.

Figure 3:
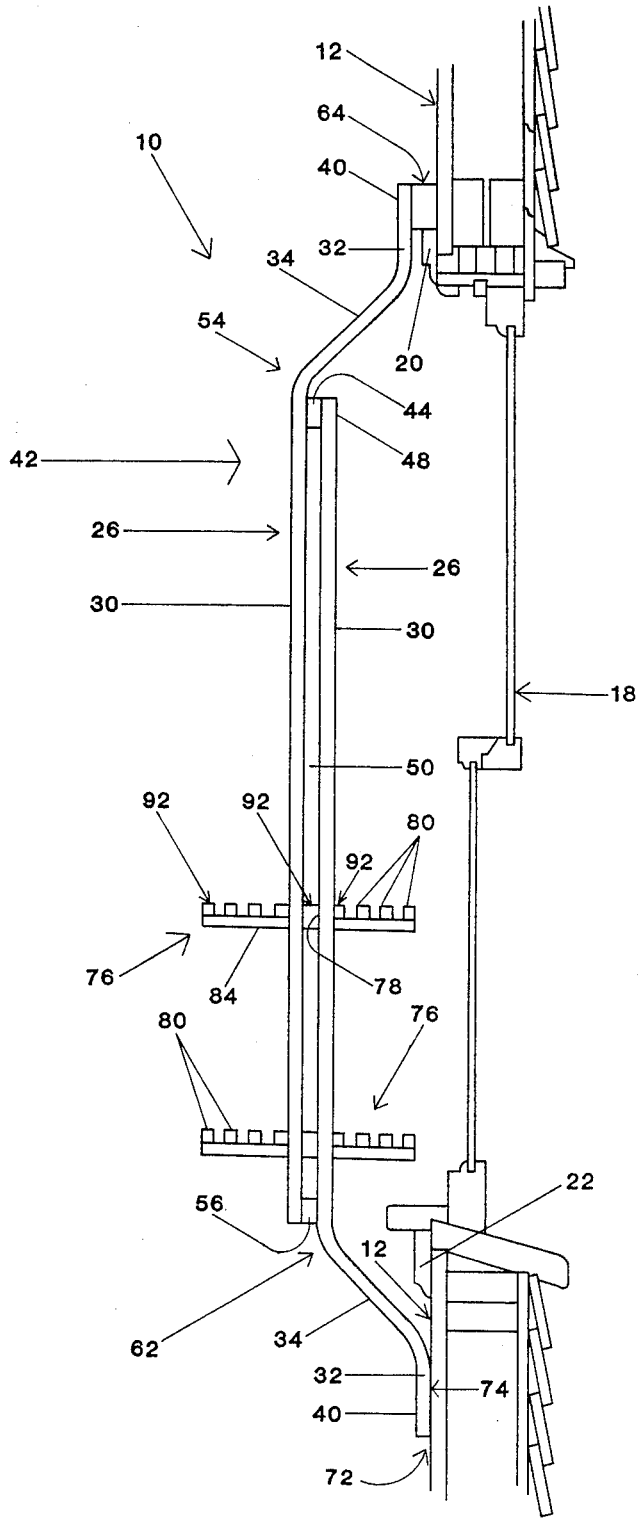
FIG. 3 is sectional side view of the shelf assembly taken along lines 3—3 of FIG. 2.
Figure 4:
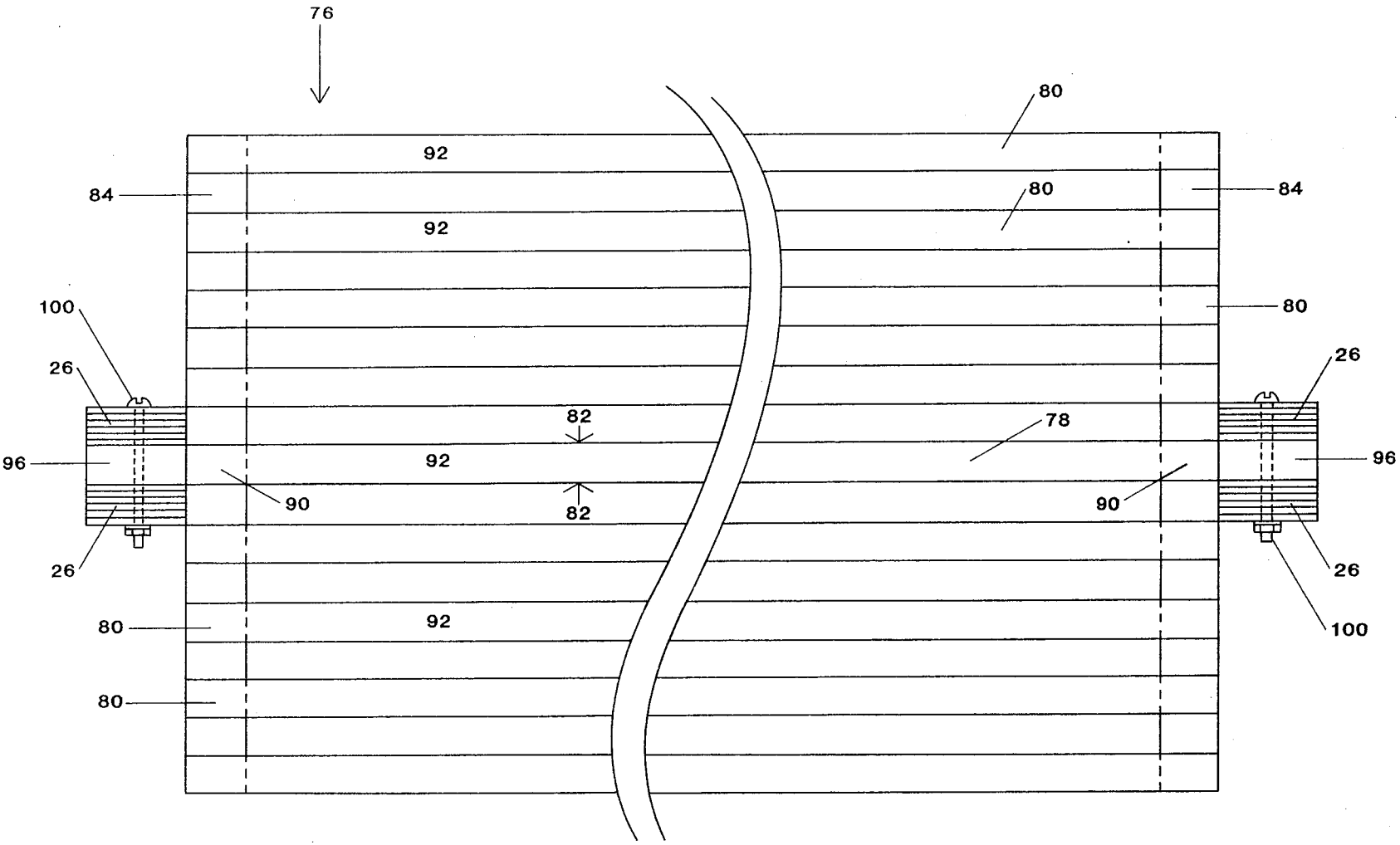
FIG. 4 is a sectional top view of the shelf assembly taken along lines 4—4 of FIG. 2.

As can be seen in FIG. 3, the connector blocks 64 have depths substantially equal to the distances between the upper outer uprights 26 and inner lower uprights 26 of the bridges 42. In this manner, the connector blocks 64 function to compensate for such distances and thus assure that the bridges 42 rest substantially in vertical planes. In addition, the rear surfaces 72 of the short vertical parts 32 of the inner lower uprights 26 may have attached thereto a strip of foam tape 74. Positioned between the inner uprights 26 and the wall 12, the foam tape 74 functions as a cushion to prevent damage to the wall 12 that may otherwise result from engagement of the rear surfaces 72 with the wall.

In addition, the assembly 10 includes at least one shelf 76. The shelf 76 comprises a central connector beam 78 and a plurality of shelf elements 80 positioned in side-by-side spaced relationship adjacent lateral ends 82 of the connector beam and in substantially the same horizontal plane in which the connector beam is disposed. The shelf 76 also has, on each side 28 of the assembly 10, a base support 84 rigidly secured to bottom sides 86 of the connector beam 78 and the shelf elements 80. The base supports 84 have recessed portions 88 adapted to receive the connector beam from underneath the same and near axial ends 90 of the connector beam. In this manner, the base supports 84 function to rigidly position the shelf elements 80 and the connector beam 78 in substantially the same horizontal plane so that top sides 92 of the same are flush with respect to each other.

Preferably, the base supports 84 are connected to the connector beam 78 and shelf elements 80 by a number of staples 94 which extend through the base supports and into the shelf elements and connector beam from the bottom sides 86 thereof. It is contemplated, however, that the base support 84 can be secured to the connector beam 78 and shelf elements 80 by any other suitable mechanical connecting means, such as by glue or screws. In addition, the connector beam 78 has on each axial end 90 thereof a flange 96 having an orifice 98 extending horizontally therethrough. The flange portions 96 are positioned in the spaces 50 between the uprights 26 of the bridges 42 so that the orifices 98 are aligned with corresponding selected sets of aligned first holes 36. A fourth pin 100 extend through each set of aligned first holes and orifice to securely attach the shelf 76 to the bridges 42.

As stated above, the bridges 42 are positioned outwardly from the side elements 24 of the window frame 14. So positioned, the bridges 42 support the shelf 76 a sufficient distance away from the window so that the assembly permits unhindered operation of window shades (not shown) and blinds (not shown) mounted adjacent to the window 18.

As indicated previously, the shelf 76 may be adjustably positioned in a variety of horizontal planes with respect to the bridges 42. This is accomplished by aligning the orifices 98 of the connector beam 78 with any two corresponding sets of aligned first holes 36 of the bridges 42 and securing the shelf to the bridges in the manner set forth above. Also, the assembly 10 may include more than one shelf 76. As shown in FIG. 3, two shelves 76 are secured to the bridges in stacked relationship and in the same manner as described above.

Further, the assembly 10 can be made to fit windows of various heights by either (1) aligning the first holes 36 of the lower inner uprights 26 with any selected first holes 36 of the upper outer uprights in such a manner that the overall length of the assembly 10 corresponds to the vertical dimensions of the window to which the assembly is to be mounted or (2) manufacturing uprights 26 with longer or shorter dimensions as is required. The latter method is preferred when it is desired to fit the assembly 10 to relatively large windows, such as sliding-door windows (not shown). In addition, the top spacer 44 and shelf 76 may be manufactured in different lengths to accommodate windows of substantially different widths.

Also, as shown in FIG. 1, the assembly may include a drip pan 102 positioned underneath the shelf 76 and functioning to catch water, dirt and other debris falling off potted plants 16 positioned on the shelf and dropping between the spaced shelf elements 80. The pan 102 is rigidly secured to the shelf 76 at the bottom sides 86 of the connector beam 78 and the shelf elements 80. To this end, the pan 102 has a lip 104, on an outside outer edge 106 and on an inside upper edge 108 of the pan, through which any suitable mechanical connecting means, such as staples or screws, may extend through and into the shelf 76 to securely attach the pan to the same.

Figure 2:
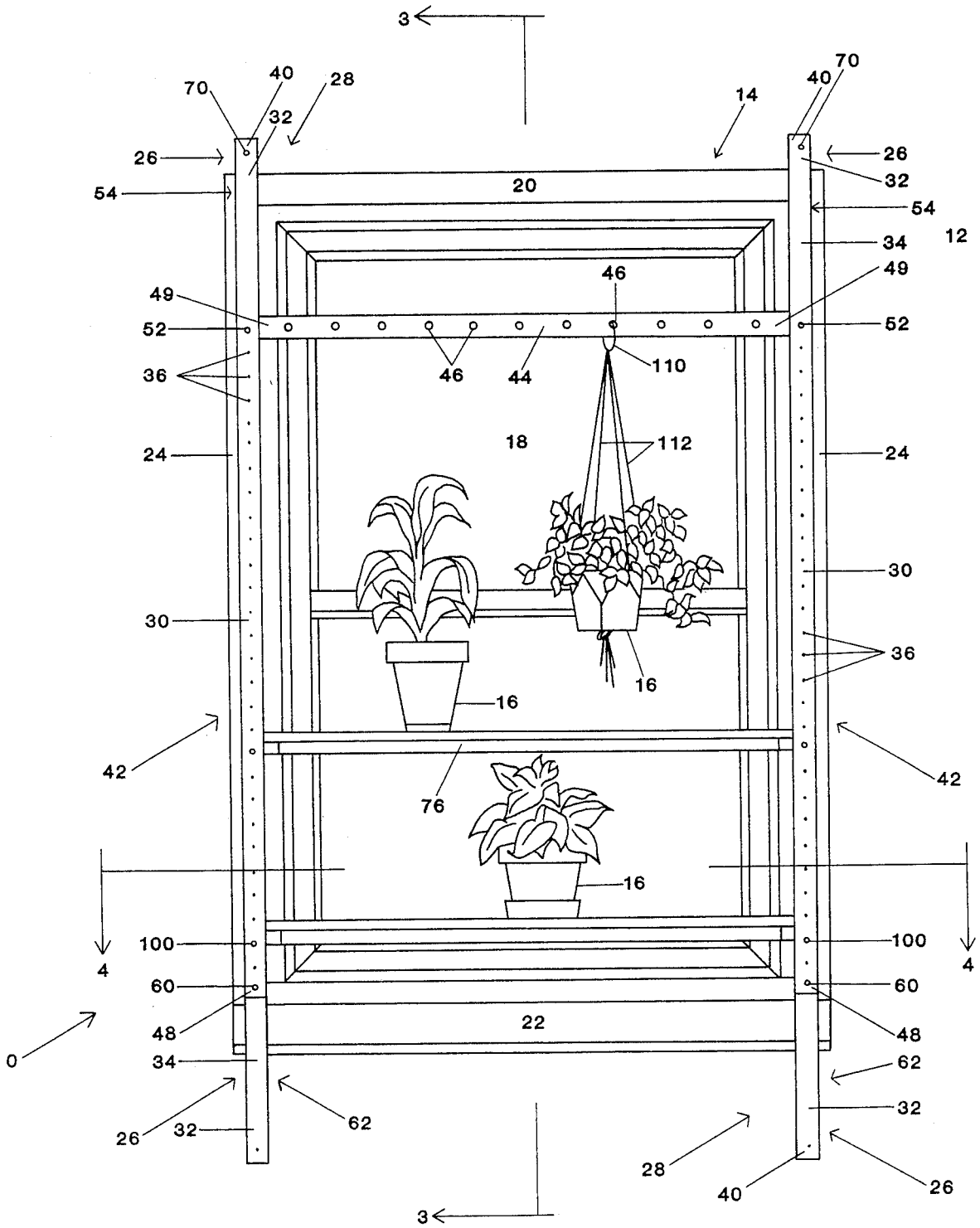
FIG. 2 is a front view of the shelf assembly mounted to a wall adjacent a window.

The apertures 46 in the top spacer 44 are particularly useful in positioning potted plants 16 adjacent the window 18. As shown in FIG. 2, the openings 47 are adapted to receive rings 110 to which ropes 112 may be tied to suspend potted plants 16.

In the preferred embodiment, the uprights 26, top spacer 44, bottom spacers 66, connector blocks 64 and shelf 76 are constructed of any suitable finished or unfinished wood product. So constructed, the assembly 10 may contribute to the aesthetic attractiveness of the interior of the homes or offices in which the assembly is employed. It is contemplated, however, that the foregoing elements of the assembly can be constructed of any suitable metal, such as aluminum, or plastic. The drip pan is preferably manufactured out of a light metal which is relatively resistant to the process of oxidation, such as stamped or folded aluminum, although other nonmetallic materials may be employed, such as plastic.

Figure 5:
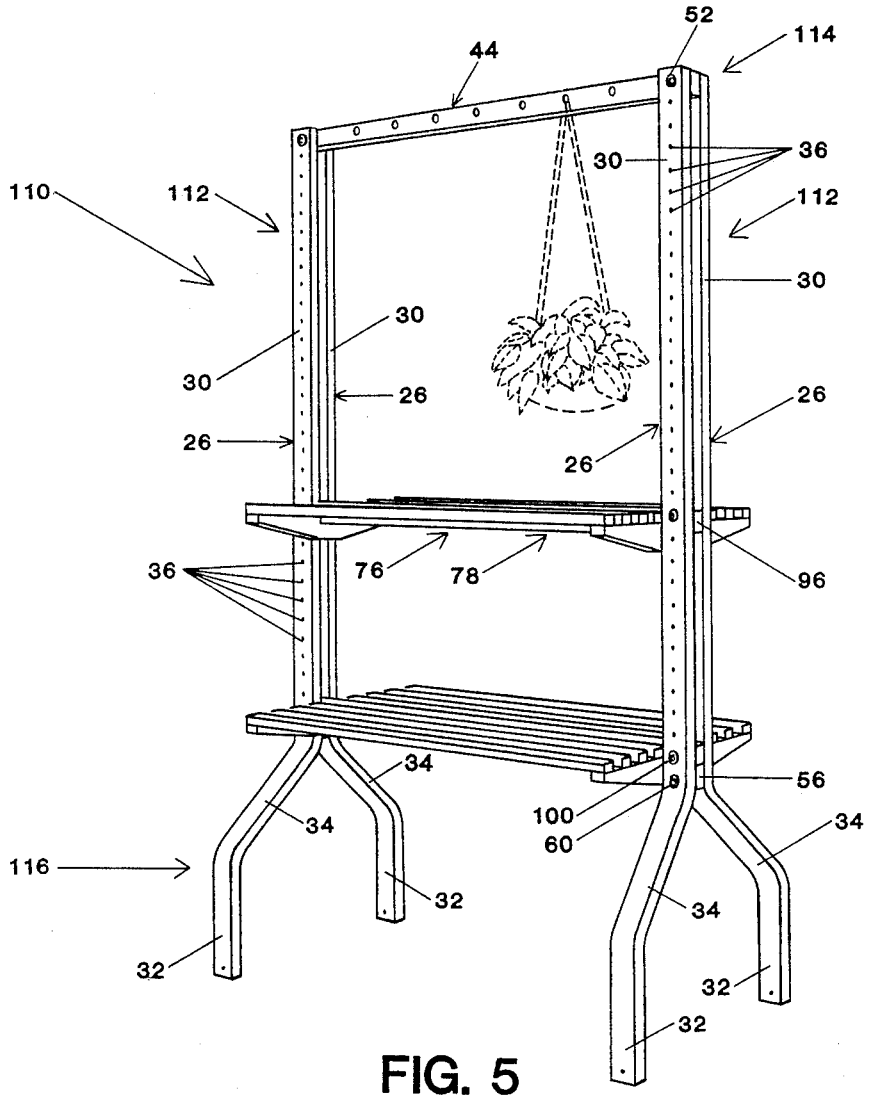
FIG. 5 is a perspective view of a freestanding shelf assembly in accordance with the invention.

Further, in an alternative embodiment of the invention, the two pairs of uprights 26 can be arranged and mounted together so as to form a freestanding shelf assembly 110 as illustrated in FIG. 5. To this end, on each side 112 of the assembly 110, a pair of uprights 26 are positioned in opposing relationships so that the long, vertical parts 30 of the same are positioned in close opposing relationship at a top 114 of the freestanding assembly, the center parts 34 of the uprights diverge and the short vertical parts 32 are positioned relatively far apart in opposing relationship a bottom 116 of the freestanding assembly. In addition, the top spacer 44 is sandwiched between the vertical parts 30 of the uprights 26 at the top 114 of the assembly 110 and the flange 96 of the connector beam 78 of the shelf 76 and the bottom spacer 56 are similarly positioned at the bottom 116 of the assembly 110. In this manner, a pair of aligned first holes 36 of the uprights 26 are aligned with the opening 47 of the top spacer 44, the orfice 98 of the flange 96 of the connector beam 78 is aligned with another pair of aligned first holes 36 of the uprights 26 and the second aperture 58 of the bottom spacer 56 is aligned with a third set of aligned first holes 36. The uprights 26 are securely mounted together in a manner similar to that discussed above with respect to the window mounted shelf assembly 10 so that the first pins 52 extend through the aligned first holes 36 and the opening 47, the second pins 60 extend through the aligned second aperture 58 and the first holes 36 and the fourth pins 100 extend through the aligned orfice and first holes 36. In this manner, one or more shelves 76 are mounted to the assembly 110 and are adapted to support potted plants 16 and the like. The assembly 11 can be positioned adjacent a window so that the potted plants are in a position to receive sunlight.

While the invention has been described in connection with a preferred embodiment, it will be understood that the invention is not limited to the disclosed embodiment. To the contrary, reasonable variations, alternatives, modifications and equivalents are possible within the spirit and scope of the invention as defined by the appended claims.

The embodiments of the invention in which an exclusive property or privilege is claimed are defined as follows:

1. A shelf assembly adapted to mount to a wall adjacent a window frame, said window frame comprising an upper horizontal portion, a lower horizontal portion and a pair of said portions, wherein said shelf assembly comprises:

a bridge on each side of said shelf assembly, mountable to said wall adjacent said window frame and comprising a pair of uprights, with each of said uprights comprising a long vertical part, a short vertical part and a central part connected to and between said short and long vertical parts and angled with respect thereto, and each pair of said uprights being adapted to mount to said wall in inverse relationship so that said short vertical parts engage said wall substantially above and below said upper and lower horizontal portions, respectively, and said long vertical parts are positioned in front of said side portions in overlapping spaced-apart relationship so as to define a channel therebetween; and at least one shelf comprising mounting means extending longitudinally of said shelf and received in said channels to mount said shelf to and between said bridges at transverse ends of said shelf.

2. A shelf assembly according to claim 1, wherein said bridges have top ends and bottom ends; and said shelf assembly further comprises a top spacer connected to and between said bridges and positioned in said channels at said top ends of said bridges, and a pair of bottom spacers secured to said bridges and positioned between said long vertical parts of said uprights and in said channels at said bottom ends of said bridges.

3. A shelf assembly according to claim 1, wherein said mounting means comprises a connector beam extending longitudinally of said shelf and having a pair of flanges on transverse ends of said connector beam and adapted to mount to and between said bridges such that said flanges are positioned in said channels between said long vertical parts of said uprights; and said shelf further comprises a plurality of shelf elements positioned on longitudinal sides of said connector beam and at least one base support adapted to mount to said connector beam and said shelf elements to securely position said connector beam and said shelf elements in substantially the same horizontal plane;

whereby said connector beam and said shelf elements have substantially coplanar upper surfaces for supporting an article on said shelf.

4. A shelf assembly according to claim 1, wherein said bridges have top ends and bottom ends;

said shelf assembly further comprises a top spacer connected to and between said bridges and positioned in said channels at said top ends of said bridges, and a pair of bottom spacers secured to said bridges and positioned between said long vertical parts of said uprights and in said channels at said bottom ends of said bridges; and said mounting means comprises a connector beam extending longitudinally of said shelf and having a pair of flanges on transverse ends of said connector beam and adapted to mount to and between said bridges such that said flanges are positioned in said channels between said top spacer and said bottom spacers; and said shelf further comprises a plurality of shelf elements positioned on longitudinal sides of said connector beam and at least one base support adapted to mount to said connector beam and said shelf elements to securely position said connector beam and said shelf elements in substantially the same horizontal plane;

whereby said connector beam and said shelf elements have substantially coplanar upper surfaces for supporting an article on said shelf.

5. A shelf assembly according to claim 4, wherein said long vertical parts of said uprights include a plurality of vertically spaced holes, said holes on said overlapping uprights of each of said bridges adapted to align;

said top spacer includes a pair of openings on free ends thereof and adapted to align with first selected sets of aligned holes in said overlapping uprights when said top spacer is positioned in said channels;

said bottom spacers include a pair of apertures adapted to align with second selected sets of aligned holes in said overlapping uprights when said bottom spacers are positioned in said channels; and said shelf assembly further comprises a pair of first pins and a pair of second pins adapted to extend through each set of said aligned holes and openings and each set of aligned openings and apertures, respectively, to rigidly secure together said uprights of said bridges in spaced-apart relationship;

whereby said shelf assembly is adapted to adjustably mount to said wall adjacent said window frame by selectively aligning said holes of said overlapping uprights, said openings of said top spacer and said apertures of said bottom spacers so as to vary vertical dimensions of said bridges.

6. A shelf assembly according to claim 5, wherein said flanges of said connector beam include a pair of orifices adapted to align with third selective sets of aligned holes of said overlapping uprights between said top spacer and said bottom spacers; and said shelf assembly further comprises a pair of third pins adapted to extend through said selective sets of aligned holes and orifices to rigidly secure said shelf to said bridges;

whereby said shelf is adapted to adjustably mount to and between said bridges by selectively aligning said orifices of said connector beam with corresponding sets of aligned holes of said overlapping uprights.

7. A shelf assembly according to claim 6, wherein said shelf assembly further comprises a drip pan securely attached to said shelf on bottom sides thereof.

8. A shelf assembly comprising upper and lower ends, at least one shelf and a pair of supports, with each support comprising a pair of uprights each having a long vertical part, a short vertical part and a central part interconnecting said short and long vertical parts and angled with respect thereto, said shelf being adapted to be mounted to and between said supports, and said shelf assembly being adapted to be assembled in one of two arrangements comprising a wall-mounted arrangement and a free-standing arrangement; wherein in said wall-mounted arrangement, each pair of said uprights is mountable to a wall in inverted relationship such that said short vertical parts engage such wall in spaced-apart relationship, said long vertical parts are positioned in over-lapping relationship in front of such wall and said shelf is mounted to and between said supports; and in said freestanding arrangement, each pair of said uprights is mountable together in upright relationship such that said long vertical parts are positioned in relatively close opposing relationship at said upper end of said shelf assembly, said central parts diverge downwardly and outwardly from one another, said short veticla parts are spaced apart at said lower end of said shelf assembly to provide a relatively wide base of support therefor and said shelf is mounted to and between said supports.

9. A shelf assembly according to claim 8, wherein in said wall-mounted and freestanding arrangements said long vertical parts of each pair of said uprights are positioned in spaced-apart relationship so as to define a channel therebetween; and said shelf assembly further comprises a top spacer connected to and between said supports and positioned in said channels at said upper end of said shelf assembly, and a pair of bottom spacers secured to said supports and positioned between said long vertical parts of said uprights and in said channels at said lower end of said shelf assembly.

10. A shelf assembly according to claim 8, wherein said shelf comprises mounting means extending longitudinally of said shelf and received in said channels to mount said shelf to and between said supports at transverse ends of said shelf.

11. A shelf assembly according to claim 10, wherein said mounting means comprises a connector beam extending longitudinally of said shelf and having a pair of flanges on transverse ends of said connector beam and adapted to be mounted to and between said supports such that said flanges are positioned in said channels between said long vertical parts of said uprights; and said shelf further comprises a plurality of shelf elements positioned on longitudinal sides of said connector beam and at least one base support adapted to be mounted to said connector beam and said shelf elements to securely position said connector beam and said shelf elements in substantially the same horizontal plane.

12. A shelf assembly according to claim 8, wherein in said wall-mounted and freestanding arrangements said long vertical parts of each pair of said uprights are positioned in spaced-apart relationship so as to define a channel therebetween;

said shelf assembly further comprises a top spacer connected to and between said supports and positioned in said channels at said upper end of said shelf assembly, and a pair of bottom spacers secured to said supports and positioned between said long vertical parts of said uprights and in said channels at said lower end of said shelf assembly; and said shelf comprises mounting means extending longitudinally of said shelf and received in said channels to mount said shelf to and between said supports at transverse ends of said shelf.

13. A shelf assembly according to claim 12, wherein said mounting means comprises a connector beam extending longitudinally of said shelf and having a pair of flanges on transverse ends of said connector beam and adapted to be mounted to and between said supports such that said flanges are positioned in said channels between said top spacer and said bottom spacers; and said shelf further comprises a plurality of shelf elements positioned on longitudinal sides of said connector beam and at least one base support adapted to be mounted to said connector beam and said shelf elements to securely position said connector beam and said shelf elements in substantially the same horizontal plane.

14. A shelf assembly according to claim 13, wherein said long vertical parts of said uprights include a plurality of vertically spaced holes, said holes in said overlapping uprights of each of said supports being adapted to align;

said top spacer includes a pair of openings on free ends thereof and adapted to align with first selected sets of aligned holes in said overlapping uprights when said top spacer is positioned in said channels;

said bottom spacers include a pair of apertures adapted to align with second selected sets of aligned holes in said overlapping uprights when said bottom spacers are positioned in said channels; and said shelf assembly further comprises a pair of first pins and a pair of second pins adapted to extend through each set of aligned holes and openings and each set of aligned openings and apertures, respectively, to secure together said uprights of said supports in spaced-apart relationship in one of said wall-mounted and freestanding arrangements.

15. A shelf assembly according to claim 14, wherein said flanges of said connector beam include a pair of orifices adapted to align with third selective sets of aligned holes of said overlapping uprights between said top spacer and said bottom spacers; and said shelf assembly further comprises a pair of third pins adapted to extend through said selective sets of aligned holes and orifices to secure said shelf to said supports in one of said wall-mounted and freestanding arrangements.

whereby said shelf is adapted to adjustably mount to and between said supports by selectively aligning said orifices of said connector beam with corresponding sets of aligned holes of said overlapping uprights.

16. A shelf assembly according to claim 15, wherein said shelf assembly further comprises a drip pan securely attached to said shelf on a bottom side thereof.

* * * * *